US005540761A

United States Patent [19]

Yamamoto

[11] Patent Number: 5,540,761

[45] Date of Patent: Jul. 30, 1996

[54] FILTER FOR PARTICULATE MATERIALS IN GASEOUS FLUIDS

[76] Inventor: Yujiro Yamamoto, 1201 Via LaJolla, San Clemente, Calif. 92672

[21] Appl. No.: 342,923

[22] Filed: Nov. 21, 1994

Related U.S. Application Data

[63] Continuation-in-part of Ser. No. 230,474, Apr. 20, 1994, Pat. No. 5,368,635, which is a continuation of Ser. No. 17,300, Feb. 12, 1993, abandoned, which is a continuation of Ser. No. 805,006, Dec. 11, 1991, abandoned.

[51] Int. Cl.[6] ..... B03C 3/155

[52] U.S. Cl. ..... 96/67; 96/99

[58] Field of Search ..... 96/17, 63, 57–59, 96/65–70, 99; 55/279, 528, 529; 95/69, 70; 110/216, 217, 345; 422/4, 5, 120

[56] References Cited

U.S. PATENT DOCUMENTS

| | | | |
|---|---|---|---|
| 895,729 | 8/1908 | Cottrell | 95/73 |
| 2,116,509 | 5/1938 | Cottrell | 204/181.9 |
| 2,579,440 | 12/1951 | Palmer | 96/40 |
| 2,593,377 | 4/1952 | Wintermute | 95/70 |
| 2,634,818 | 4/1953 | Wintermute | 96/36 |
| 3,028,864 | 4/1962 | Minto | 131/333 |
| 3,237,387 | 3/1966 | Haugen et al. | 55/519 X |
| 3,392,509 | 7/1968 | Pelosi, Jr. | 96/66 |
| 3,537,238 | 11/1970 | Dungler | 55/462 X |
| 3,945,813 | 3/1976 | Iinoya et al. | 96/29 |
| 4,205,969 | 6/1980 | Matsumoto | 96/66 |
| 4,244,710 | 1/1981 | Burger | 55/279 X |
| 4,244,712 | 1/1981 | Tongret | 55/279 X |
| 4,313,740 | 2/1982 | Kalishman | 55/527 X |
| 4,313,741 | 2/1982 | Masuda et al. | 96/78 |
| 4,321,066 | 3/1982 | Masuda | 96/40 |
| 4,405,342 | 9/1983 | Bergman | 55/354 X |
| 4,541,847 | 9/1985 | Oie et al. | 55/279 X |
| 4,549,887 | 10/1985 | Joannou | 55/493 X |
| 4,581,046 | 4/1986 | Bergman | 55/484 X |
| 4,623,365 | 11/1986 | Bergman | 55/498 X |
| 4,654,054 | 3/1987 | Snaddon et al. | 96/68 |
| 4,662,903 | 5/1987 | Yanagawa | 96/59 |
| 4,702,752 | 10/1987 | Yanagawa | 55/529 X |
| 4,715,870 | 12/1987 | Masuda et al. | 96/67 |
| 4,737,169 | 4/1988 | Bossard | 96/58 |
| 4,759,778 | 7/1988 | Conrad | 96/59 |
| 4,938,786 | 7/1990 | Tonomoto | 55/528 X |
| 4,978,372 | 12/1990 | Pick | 96/67 |
| 5,024,681 | 6/1991 | Chang | 110/217 X |
| 5,108,470 | 4/1992 | Pick | 96/58 |

OTHER PUBLICATIONS

Kanagawa Industrial Tech Development, Japanese Newspaper, Oct., 1989.

Nikkei Mechanical Japanese Publication, p. 81, Oct. 1989.

*Primary Examiner*—Richard L. Chiesa

*Attorney, Agent, or Firm*—Walter A. Hackler

[57] ABSTRACT

A clog-resistant filter for extracting fine particulate contaminants, such as smoke, from a gaseous fluid stream, such as air, uses interaction between Van der Waals forces and a non-ionizing electrostatic field to efficiently capture the contaminant particles in a filter material whose pores are many times larger than the diameter of the particles to be captured. The filter material is physically so configured to further enhance that interaction and is disposed between at least a pair of electrodes of opposite polarity. The material may be spaced apart from the electrodes, but preferably touches one of them. The particles are trapped generally throughout the thickness of the filter material but ample room is left for continued air flow. The electrostatic voltage is preferably between 3 and 9 kV and is largely independent of electrode spacing. The configuration of the filter material is such that the flow velocity through the material is less than 0.1 m/sec, preferably on the order of 0.03 m/sec.

6 Claims, 6 Drawing Sheets

FILTER FOR PARTICULATE MATERIALS IN GASEOUS FLUIDS

FIELD OF THE INVENTION

This application is a continuation-in-part of U.S. patent application Ser. No. 08/230,474filed Apr. 20, 1994, now U.S. Pat. No. 5,368,635 which is a continuation of U.S. patent application Ser. No. 08/017,300 filed Feb. 12, 1993, now abandoned, which is a continuation of U.S. patent application Ser. No. 07/805,006 filed Dec. 11, 1991, now abandoned.

This invention relates to filters for removing small particulate materials from a gaseous fluid such as air, and more specifically to an electrostatic filter, relying principally on Van der Waals forces to entrap the particulate materials.

BACKGROUND OF THE INVENTION

Many types of electrostatic filters have been proposed for removing small particulate materials such as dust, smoke, and the like from gases such as air or the exhaust gases of vehicles or industrial processes. Typically, such filters rely in one way or another on the ionization of the particulate material by a fixed high voltage electric field, so that they may be trapped and held by electrostatic forces. Common disadvantages of ionizing electrostatic filters are that they operate at sufficiently high voltages, requiring expensive insulation and safety precautions, as well as substantial power, and that they produce ozone, which constitutes a health hazard. There are a number of additional problems with known electrostatic filter technologies, whereby the attraction and collection of particulates to the filter materials are accomplished by Coulomb's Law, including flocculating effects, creating unpredictable occasional bursts of release of dust, inadequate dust-holding capacity, requiring more frequent maintenance, and other common disadvantages associated with high voltage utilization. Thus, electrostatic filtration is used today mainly as a pre-filter or general purpose filter for commercial purposes, without requiring realistic high performance.

Non-ionizing electrostatic filters have also been proposed in the past, but their use tends to be limited to special situations, such as the capture of partially conductive soot particles from diesel exhaust.

Mechanical filters (including high efficiency particulate air (HEPA) and ultra-low penetration air (ULPA) filters not using electric fields are also common, but they are basically unable to capture particles smaller than their pore size; and they are also subject to rather rapid clogging by captured particles. The clogging takes place mostly on the inflow surface of the filter, and the thickness of the filter material for holding particles is not utilized as it would simply increase the air pressure drop across the filter.

SUMMARY OF THE INVENTION

Filter apparatus for trapping particles suspended in a gaseous fluid stream generally includes a filter chamber for defining an air flow path between an inlet and outlet and a porous filter disposed in the flow path with the porous filter comprising a dielectric fibrous material, having a pore size substantially larger than the average diameter of the particles to be trapped. In addition, the filter has a collection surface thereon substantially larger than a cross-section of the flow path. In this regard, preferably the porous filter is pleated.

Impelling means is provided for causing the gaseous fluid stream and particles suspended therein to flow along a flow path and through the porous filter. Three electrodes are disposed in operative relationship with the porous filter material for enhancing trapping of the particles by the porous filter. The electrodes are parallel (planar or concentric), positioned between the inlet and outlet and include openings therein for enabling air flow perpendicular to the electrodes without significant resistance.

The porous filter material is disposed between two of the three electrodes and air flows sequentially through a first electrode, a second electrode, the porous filter, and then through the third of the three electrodes.

Accordingly, means are provided for applying a selected DC voltage across only two of the three electrodes with one electrode purposely not connected directly to any power supply or voltage potential.

In one embodiment of the present invention, the means for applying the voltages is configured for applying the voltage across the second and third electrodes. In another embodiment, the means for applying the voltage is configured for applying the voltage across the second and third electrodes. In yet another embodiment, the means for applying the voltages is configured for applying the voltage across a first and third electrode. In either of these embodiments, one of the electrodes is "electrically floating", i.e., no electrical potential is directly applied thereto.

While the voltage applied across the two electrodes may be sufficient for ionizing the particles, it is preferable that a non-ionizing potential be utilized.

The three electrodes may be coaxially disposed, and preferably in this configuration, the third electrode is disposed outwardly from the first and the second electrodes. This configuration results in a filter assembly, or an apparatus, in which the outer electrode is non-electrically charged. This, of course, has a significant safety advantage.

When a non-ionizing voltage is applied to two of the electrodes with the porous filter disposed there-between, the residence time of the particles in and about the porous filter is increased because of the churning of the particles within the filter as the gaseous fluid stream passes through the porous filter which, in turn, enhances trapping of the particles by the porous filter, as will be hereinafter described in greater detail.

BRIEF DESCRIPTION OF THE DRAWINGS

The advantages and features of the present invention will be better understood by the following description when considered in conjunction with the accompanying drawings in which.

Figure 6:
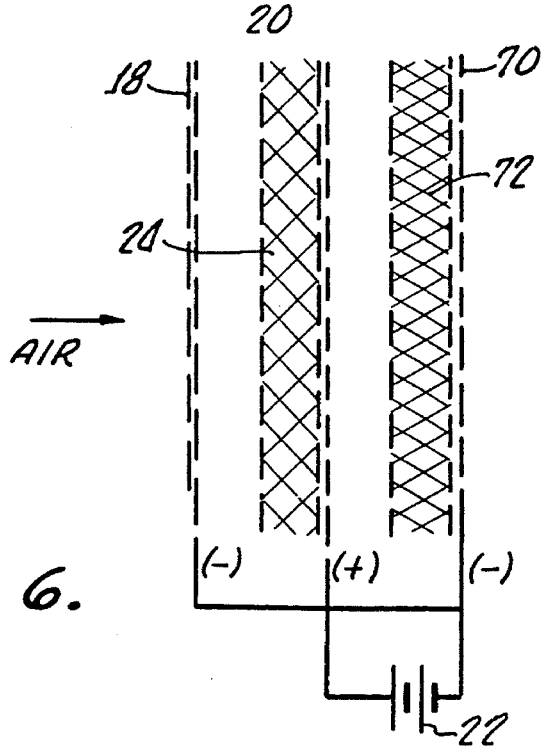
Figure 7:
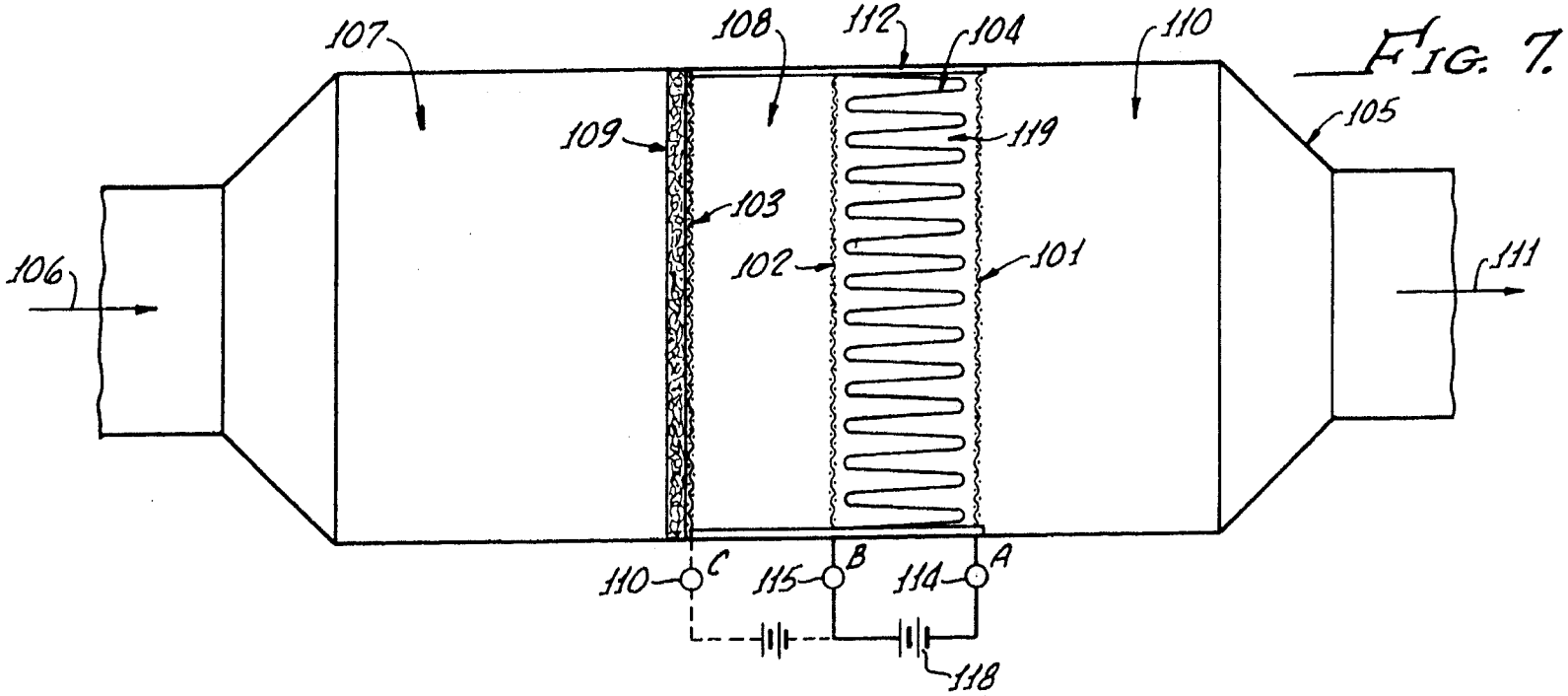
Figure 8C:
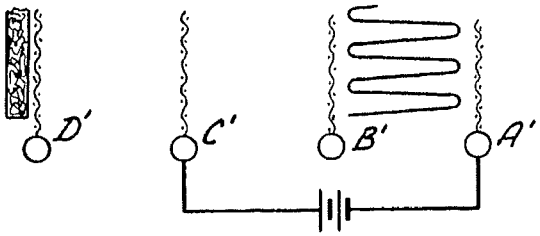
Figure 8B:
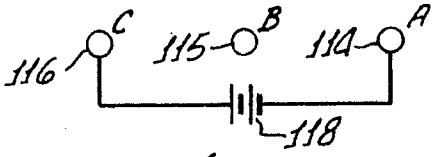
Figure 8A:
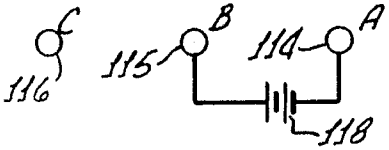
Figure 9:
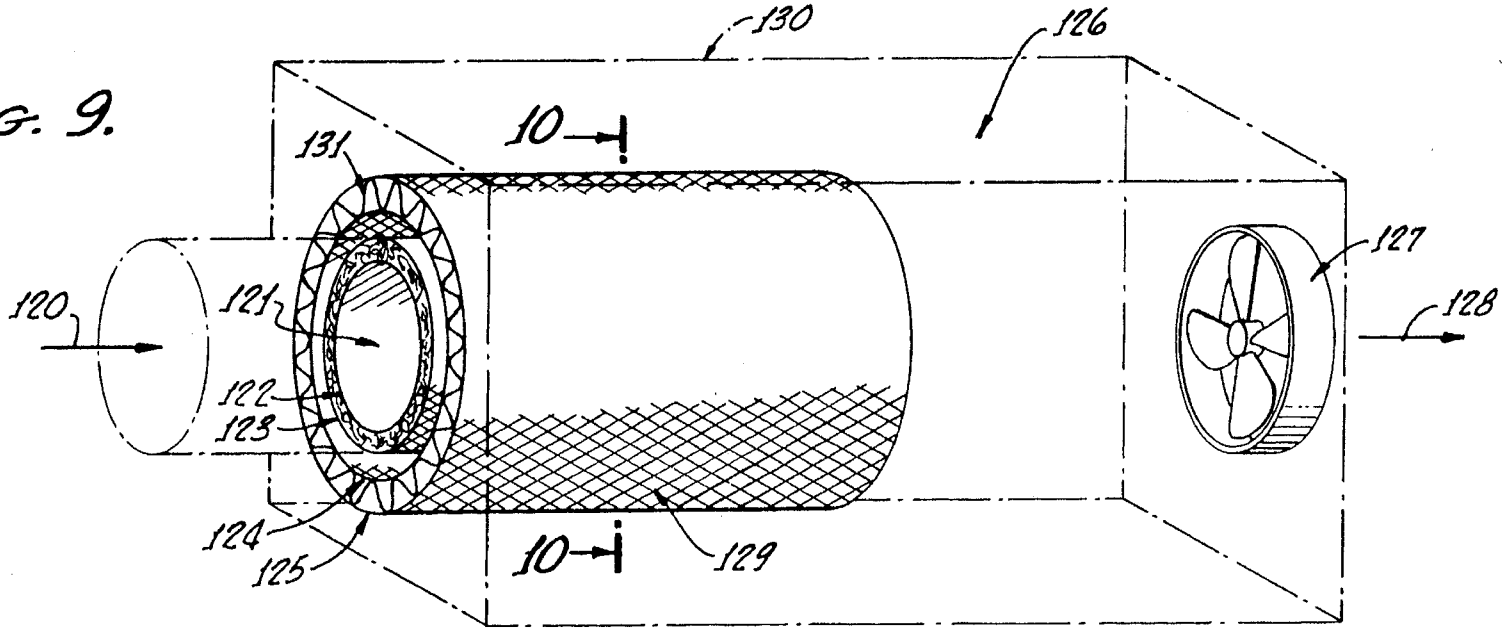
Figure 11:
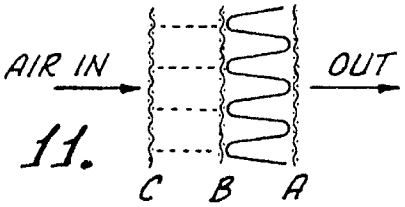
Figure 10:
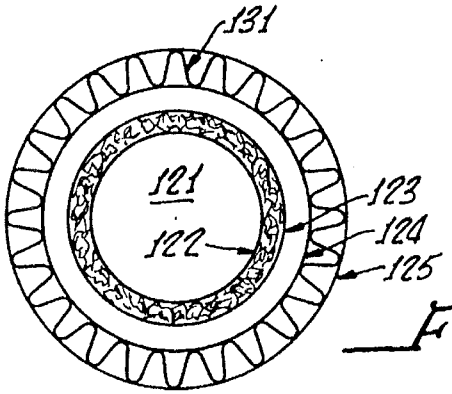

FIG. **5*a*** is a vertical section of an alternative embodiment of the invention;

FIG. **5*b*** is a detail section of an alternative electrode design;

FIG. 6 is an illustration of an alternative embodiment of the present invention utilizing three electrodes;

FIG. 7 is a vertical section of yet another embodiment of the present invention;

FIGS. 8*a*, 8*b* and 8*c* show the application of electrostatic voltages and a floating electrode in different arrangements;

FIG. 9 shows a cylindrically formed filter with three-electrode configuration;

FIG. 10 shows the cylindrical inner structure of the three-electrode filter; and 5 FIG. 11 shows unifying the equipotential line over the tips of the pleated filter material by the mid-electrode.

DETAILED DESCRIPTION OF THE PREFERRED EMBODIMENTS

Figure 1:
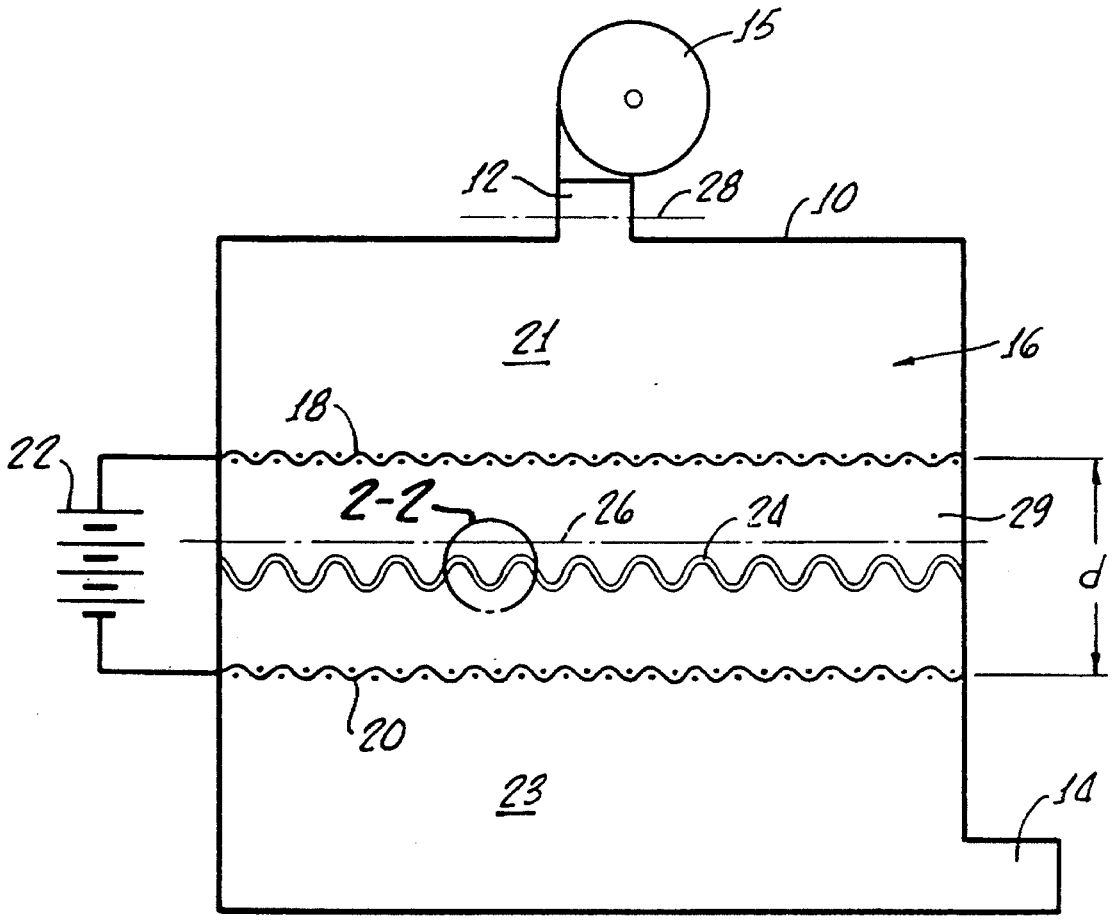
FIG. 1 is a vertical section of a filter constructed in accordance with the present invention.

Turning to FIG. 1, there is illustrated a filter constructed in accordance with the present invention. A filter housing 10 has an inlet pipe 12 at its top and an outlet pipe 14 at its bottom. A gaseous fluid, such as air, contaminated with suspended particulate materials, e.g., dust or smoke, is conveyed through the flow path from inlet pipe 12 to outlet pipe 14 by appropriate impelling means schematically illustrated as a pump 15. The housing 10 encloses a filter chamber 16 in which a pair of apertured electrodes 18, 20 are disposed, transversely to the axis of the chamber 16, between an intake plenum 21 and outlet plenum 23.

The electrodes 18, 20 may consist of a metallic mesh or a perforated metallic plate, or they may be carbonized layers of the filter material 24 itself; in either event, the openings in the electrodes 18, 20 are large enough not to significantly affect the air flow through the chamber 16.

One of the electrodes may be used as a filter. In this instance, the filter would include a conductive fiver material or a non-conductive material with conductive particles or strands interspersed therein.

The electrodes 18, 20 are connected to a direct current voltage source 22. The polarity of the electrodes 18, 20 does not greatly affect the operation of the invention in most instances. However, for optimum capture of the particles, it is preferable to use a layered arrangement with layers of filter material. Also, the polarity for most effective filtration is somewhat dependent upon the nature of the filtered particles, e.g., dielectric particles, such as dioctyl phthalate (upstream positive preferable) vs. partially conductive particles, such as cigarette smoke (downstream positive preferable). The electrodes 18 and/or 20 may be coated with an insulating material to avoid shorting or extreme reduction of resistance between the electrodes 18, 20 by accumulation of particles in the filter material 24.

Disposed between the electrodes 18, 20 is a porous filter material 24 of a shape discussed in more detail hereinafter. The material 24 is preferably a non-hygroscopic material forming a mesh. The filter material 24 may be dielectric or partially conductive; the latter being preferable. Examples of dielectric materials are paper,.glass fiber, synthetic fiber, cloth, natural fibers such as cotton (these being better because of their micro-size channels), or materials with a natural electrostatic charge such as 3M's FILTRETE® or Toray's TORI-MICRON® (Japan). an example of a suitable conductive material is a metal-impregnated fiber sheet developed by Toray Co. Ltd. and marketed under the name "Soldion paper®" by Shiga Shokusan Inc. of Japan. The average pore size of the mesh is preferably about ten to fifty times the average diameter of the particles to be captured, but even particles as small as 1/500 average pore size can be captured to a significant degree if the flow velocity is slow enough. Depending upon the application, the material 24 may be as thick as 25 mm (in a uniform, varying density, or multilayered configuration) as compared to typical pleated filter material which is about 0.5 to 1 mm thick. This vastly enhances the capacity of the filter because particle capture occurs rather evenly throughout the thickness of the material 24. Stacked pleated filter materials—such as commonly used in HEPA, ULPA, and similar filters—are preferably used for simplicity in providing the area amplification needed for slowing the fluid flow as described below.

It should be appreciated that the present invention provides a simple, highly effective, energy-saving electrostatic particle filter, which operates at substantially lower voltages than conventional electrostatic filters and uses an interaction between natural Van der Waals forces and a non-ionizing electrical field to create a churning motion of airborne particles, to increase the residence time of particles in the materials, and to trap airborne particulates in an electrically enhanced filter material. This arrangement makes it possible to capture particles of widely varying sizes more efficiently with less chance of clogging and without the formation of ozone. This arrangement also allows the porosity of the filter material to be considerably larger than the size of the particulates to be captured without a reduction in effectiveness. This results in a much lower air pressure drop across the filter.

Van der Waals forces are molecular electrostatic fields which are inherently associated with foreign particles suspended in gases, such as air. A common manifestation of these forces is the attraction of dust particles to plastic or other surfaces. Once the particles make contact with the surfaces, the Van der Waals force increases dramatically and makes the particles adhere to the surface.

The particles are not easily removable because the Van der Waals force is proportional to $1/a^6$, where "a" is the effective distance of the particles from the surface. Thus, this force provides a strong bond once contact is established. At any significant distance from the surface, Van der Waals forces are very small forces (defined by Van Nostrand's *Encyclopedia of Science* as interatomic or intermolecular forces of attraction), and they-do not come into play in conventional electrostatic filters which mostly rely on the direct attraction between charged particles and collecting surface with high potential by Coulomb's law $1/a^2$ and because the flow rate is too high to allow any significant particle capture by the Van der Waals force.

The filter of the present invention accomplishes its objectives by using a filter geometric configuration which slows the flow of the air or other gaseous fluid through the filter material to the point where the particles suspended in the fluid can be captured and held in the filter material, essentially by Van der Waals forces. Furthermore, while the flow of the air through the filter material longitudinally of the air flow path is slowed by a specific geometry, the active, generally transverse motion of the particles between the electrodes substantially increases the chance that the particles will make contact with the filter material. Consequently, the filter material captures particles much smaller than its pore size, and this minimizes pressure drop, increases the dust-holding capacity, and minimizes clogging of the filter. By the same token, as the pore size is much larger than the particles, the thickness of the filter material can be substantially increased in comparison to filter materials in conventional filters. The increased thickness of the filter material thus made possible further contributes to much more effective filtration. In the filter of the present invention, the electrostatic field is used only to enhance the action of the Van der Waals force and to impart to the particles the generally transverse motion which facilitates their capture.

Within limits, the operation of the filter of the present invention is dependent only upon the absolute voltage difference across the filter material, not upon the volts/cm field strength of conventional electrostatic filters. Consequently, the thickness of the filter material can be varied to accommodate different environments without changing the electrical components.

In accordance with another aspect of the invention, the action of the Van der Waals forces can be substantially enhanced by causing one of the electrodes to touch the filter material and the other electrode to have an air gap between it and the filter material, or by interweaving or embedding conductive fibers in the filter material. The embedded conductive fibers can consist of chopped microscopic substances (both isolated or non-isolated) which create a vast number of air gaps between the tips of conductive fibers that produce microscopic but strong electric fields in the air gaps and throughout the filter material. However, although materials of this type are generally designed for applications involving the release of static electricity by internal arcing between the fibers of the material, the voltages involved in the invention are too low to cause arcing. This results in further enhancement of the particle attraction by the Van der Waals force, and therefore more efficient filtration.

Similarly, when the filter material includes or is treated or coated with an active substance, such as, for example, activated charcoal, which chemically reacts with and absorbs the undesirable substance (e.g., odors, hazardous particles, poisonous gas) in air, the churning motion of particles created by the electrostatic field within the filter material accelerates the chemical reaction and absorption of the undesirable substances in the filter material. That is, the effectiveness of the activated charcoal, for example, in odor absorption is enhanced by the electric fields produced in accordance with the present invention.

Figure 2:
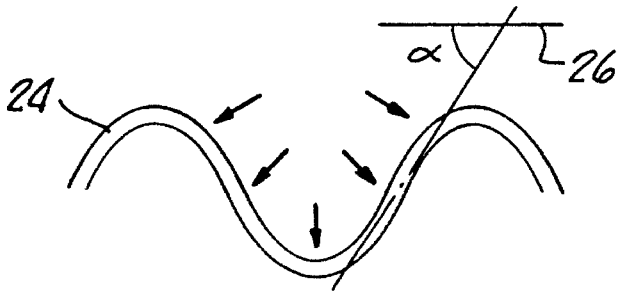
FIG. 2 is a detail section along line 2—2 of FIG. 1.

In order for the filter of this invention to effectively utilize the Van der Waals forces associated with the particles to be captured, the flow velocity of the gaseous fluid must be less than about 0.1 m/sec at least some point of any flow path the fluid can take. For optimum filtration, a flow velocity of 0.03 m/sec is preferred. For example, if the material 24 is folded, as shown in FIG. 2, the surface area of material 24 on the inlet side or the outlet side is 1/cos $\alpha$ m/sec. If $\alpha$ is 45°, the maximum flow velocity at plane 26 is 0.14 m/sec. If the area of the inlet pipe 12 in the plane 28 is, for example, 1/199 of the chamber area in plane 26, then the flow velocity in the inlet pipe 12 can be as high as 14 m/sec with $\alpha$=45°. To keep the flow of air as even as possible through the entire surface area of the filter, any sharp bend of the material should be avoided. The preferred surface contour of the filter material is similar to a sinusoidal wave shape, whereby the thickness of the material is even throughout the surface. The electrodes 18, 20 may be shaped to follow the undulations of the filter material surface, as illustrated in FIG. 5*b*.

The slow flow velocity of the particles in the direction of flow merely causes the particles to remain in the filter material 24 long enough to be captured. In a direction generally transverse to the flow direction, however, the electrostatic field imparts to the particles a turbulent motion which greatly enhances the chances, during their passage through the filter material 24, of approaching a filter material fiber sufficiently to be captured by the Van der Waals force. For this reason, it is preferable for the filter material 24 in the inventive filter to be thick (e.g., 2–3 cm) in the direction of flow, contrary to conventional filters in which most of the particle capture occurs at the materials' upstream surface.

In accordance with the present invention the DC potential difference between the electrodes 18, 20 should be at least 2 kV but not more than 10 kV, and preferably in the range of 3–9 kV, with the optimum being about 7 kV. The precise voltage selection is dependent upon the particulate material of interest, the porosity of the filter, the type of filter material used, and the velocity of the air stream through the filter.

Above 10 kV, filtration continues to improve slightly. However, that improvement is due to a partially induced ionization of the particles, which begins to occur in localized areas at about 11 kV. The problem with this is that when the filter itself thus generates ionized particles, some of those particles are entrained by the air stream and attach themselves to walls and ducts downstream of the filter. In those positions, the particles become contaminants with an unpredictable timing of release into the air—an undesirable situation for a clean room atmosphere, for example. In summary, too high a voltage wastes energy and presents a danger of ionization, without significantly improving filter performance; too low a voltage degrades the performance of the filter.

The distance d between the electrodes 18, 20 can vary over a substantial range at any given voltage with very little effect on the capture capability of the material 24. As a practical matter, the distance d is preferably kept in the range of about 5–40 mm for effective filtration. Too small a distance creates a danger of arcing; too great a distance degrades the performance of the filter. The voltage level affects the size of particles that can be captured, as well as the depth of their penetration into the filter material 24.

The properties of the filter of the present invention are illustrated by the following examples.

EXAMPLE I

A pair of electrodes 18, 20, having a mesh-like structure with apertures having an average opening of about 1 mm square, were disposed in a plastic housing 10 with an inside diameter of about 7.5 cm at a distance of about 25 mm from each other. A layer 24 of flat paper fiber material about 2 mm thick, having an average pore size of about 10 microns, was placed between the electrodes 18, 20, parallel thereto, coextensive therewith, and spaced therefrom, in the chamber 16 formed by housing 10. Air contaminated with cigarette smoke having a particle size range from about 0.01 microns to 1 micron was drawn through the chamber 16 at a rate producing a flow velocity of about 0.01 m/sec through the inlet pipe 12; thus, the flow velocity at the electrodes and filter material was much slower. As the voltage of DC voltage source 22 was varied (with the positive electrode on the downstream side—although the polarity was found to be essentially immaterial), the following was observed:

When the potential was above 10 kV, the smoke particles failed to penetrate through the electrode 18 and accumulated in the intake plenum 21. A churning cloud of smoke particles formed at this potential above the first electrode 18. it was noted that observable individual particles were moving quite rapidly within this cloud. However, when the potential was incrementally lowered from 9 kV to 3 kV without the filter material 24 in place, the layer of cloud-like smoke particles penetrated into the space 29. As the voltage was lowered, the layer lowered itself closer to the second electrode 20. However, the smoke particles stayed in the space 29 without penetrating through the lower electrode 20. when the experiment was conducted with the filter material 24 in place, essentially all of the smoke particles adhered to the material 24 with the potential ranging between 9 kV and 3 kV. Without the material 24, below 2 kV, there was no longer a layer of cloud observed, and the smoke went through both electrodes and exited to 14 through 23. With a filter material, little or no additional filtering action occurred beyond normal filtering action of the material.

When the voltage is removed or further lowered from the experimental voltage (9 kV–3 kV) to 0 V, adhered particles did not become dislodged from the material 24.

Upon repeating the experiment with thicker material 24 up to 20 mm, it was found that the thicker material provides better filtration by increasing the probability that the particles will adhere to the surface of the filter material.

As the air velocity was increased beyond 0.1 m/sec, the air flow force pushed the particles through the first electrode 18, filter material 24, and second electrode 20; thus, the above-described phenomenon was not readily observed, and filtration was very poor.

EXAMPLE II

In the apparatus of Example I, the spacing between electrodes 18, 20 was increased to about 50 mm. The same phenomena as in Example I were observed at the same voltages. In an alternative embodiment of the invention, FIG. 3 illustrates two points:

(1) that the air flow does not have to be drawn through both electrodes, and (2) that the filter material does not have to be of uniform thickness.

Figure 3:
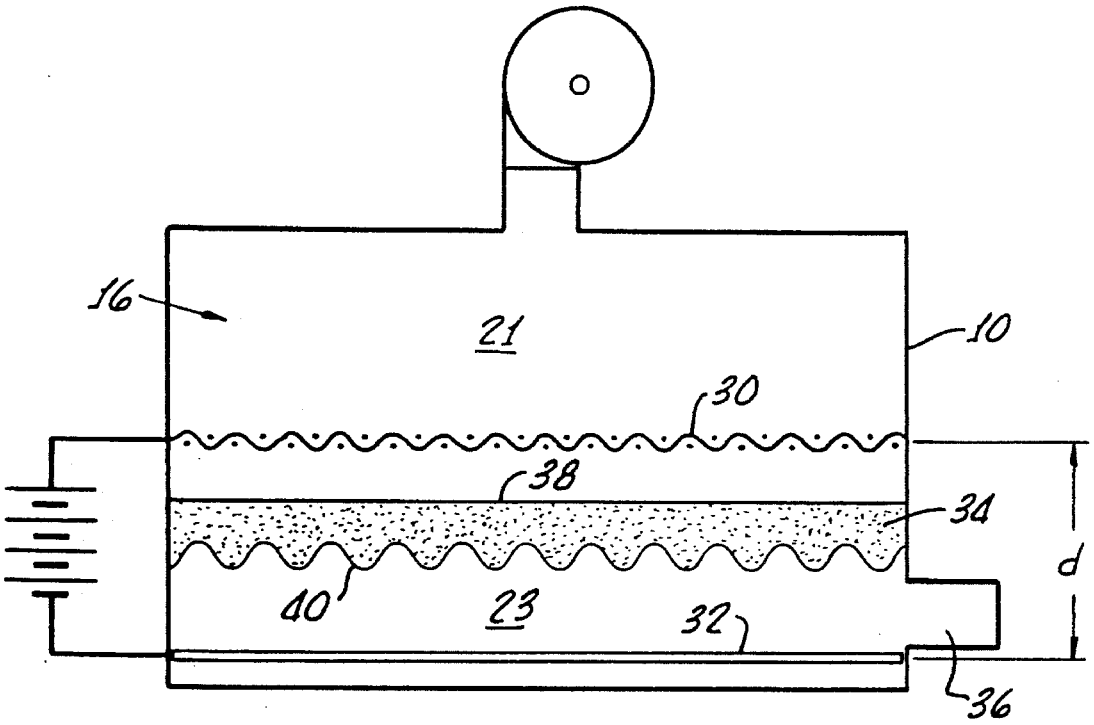
FIG. 3 is a vertical section of a modified embodiment of FIG. 1.

In FIG. 3, a pair of electrodes 30, 32 in chamber 16 have a filter material 34 disposed between them. Although the electrodes 30, 32 may both be apertured like the electrodes 18, 20 of FIG. 1, the electrode 32 may be solid in the embodiment shown in FIG. 3 because the air stream exits the chamber 16 through outlet 36 downstream of the filter material 34 but upstream of the electrode 32. (Alternatively, both electrodes may be solid, and the air inlet may be placed in the side of the chamber 16 between electrode 30 and material 34.)

A solid electrode 32 produces a slightly more uniform field in the material 34 than does a mesh electrode. In either event, however, the electrodes 30, 32 (as well as the electrodes 18, 20) should be substantially smooth and devoid of sharp bends because major surface discontinuities in the electrodes tend to concentrate the filed in a non-uniform pattern. However, a uniformly distributed irregularity (such as a surface of knitted metallic mesh) produces a better distribution of the electric field throughout the space between the two electrodes, thus creating better entrapment of particles in the filtering material 24.

The filter material 34 in the embodiment illustrated in FIG. 3 is shown as a porous, egg crate-type plastic foam material. Although the entry velocity of the air into material 34 along surface 38 at the maximum flow rate (using the flow rates and size parameters of Example I above), would be well above 0.1 m/sec, the internal geometry of the material 34 spreads the air flow so that its velocity at the exit from material 34 along the much larger surface 40 is well below the 0.1 m/sec mark. This is useful to reduce clogging where a wide size range of particles is to be trapped: very large particles tend to be mechanically trapped near the surface 38, while the entrapment of smaller particles tend to be distributed through the material 34 with maximum trapping occurring near the surface 40. This action could be enhanced by using a multilayer filter material with different porosities.

EXAMPLE III

Figure 4:
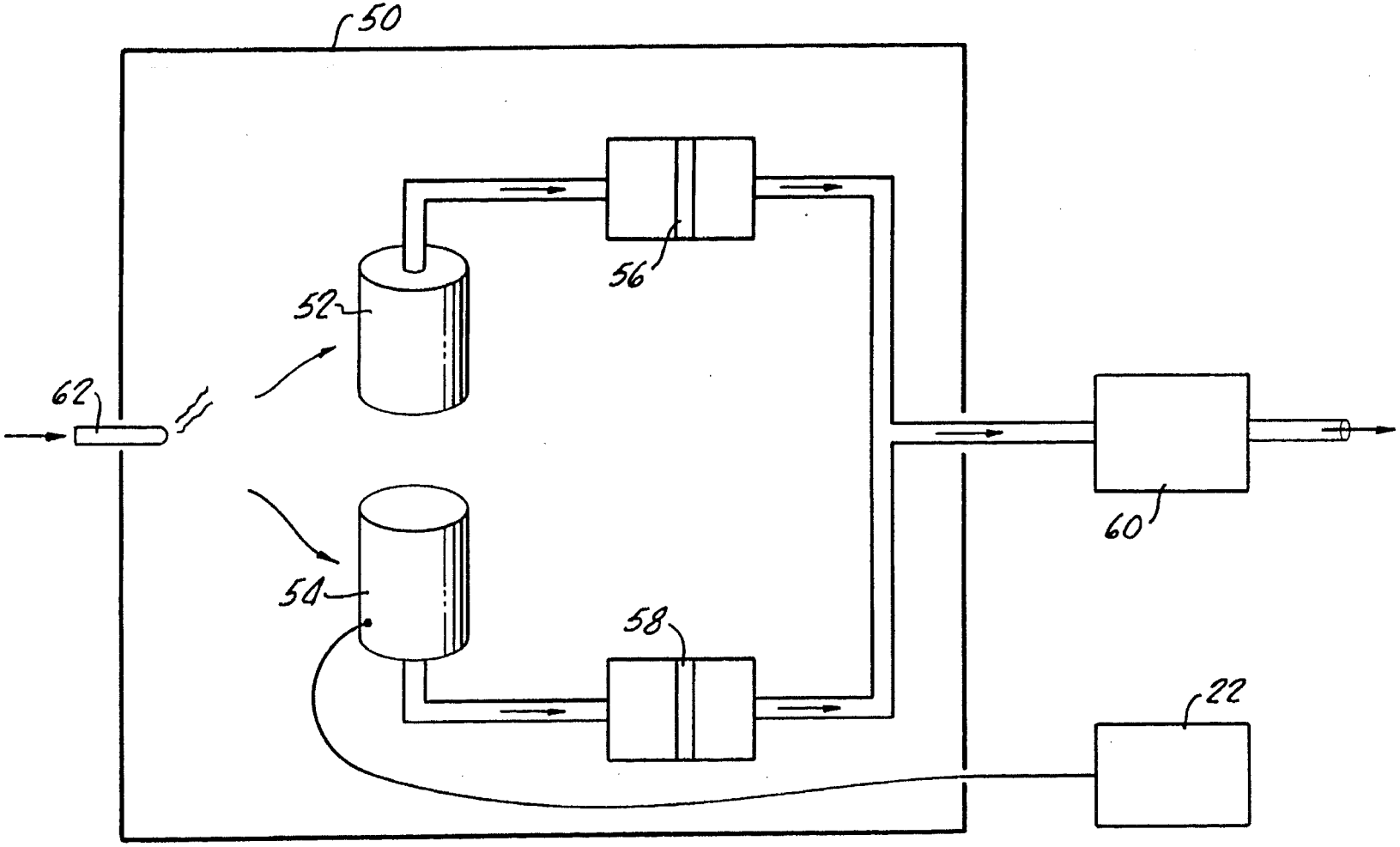
FIG. 4 is a block diagram of an apparatus for testing the invention.

An experimental filter apparatus was constructed as shown in FIG. 4, using a chamber 50 having a size of 50 cm×31 cm×26 cm. Two identical cylindrical air filters 52, 54 (PUROLATOR® Auto Air Filter, Model AF 3080) were placed side-by-side in the chamber 50. Each air filter contained a pleated filter material 24, which was sandwiched between two electrodes spaced 12 mm apart, and formed into a cylindrical structure. For the experiment, the bottom of each air filter was closed, and the top was connected to a monitoring membrane 56, 58 which collected the residual smoke particles that had penetrated through the air filter 52 or 54, respectively. The air output was sucked out by a vacuum pump 60 through the membranes 56, 58. The porosity of the air filter material was about 10 microns. Smoke particles from 0.01 to 1 micron in size were drawn from a cigarette. Air was drawn through a burning cigarette 62 (creating smoke) and introduced into the chamber at about 1 cfm (472 cubic cms/sec) rate. The smoke was then separately drawn through the walls of the two identical air filters at an equal rate and exhausted up and out of the center of the cylinders through the membranes 56, 58 and out of the chamber.

A voltage of 7 kV was applied across the electrodes of air filter 54. No voltage was applied to air filter 52. The membrane 56 downstream of the air filter 52 displayed a deposit of dark brown material (accumulation of smoke particles). The membrane 58 downstream of air filter 54 showed almost no deposit of particles—almost all particles having been absorbed in the filter material 24 between the electrodes of filter 54.

The efficiency ratio determined by observing the relative discoloration of the membranes 56, 58 was estimated to be better than 1,000 to 1. When the apparatus was new and clean, air velocity through the filter material 24 of filters 52, 54 was substantially lower than 0.1 m/sec, and when a voltage between 6 kV and 9 kV was applied, even the cigarette odor was not detectable in the air at the output of the filtering apparatus through 54 and 58.

The significance of these findings is that in the absence of an electrostatic voltage, the filter material 24 with a porosity of 10 microns allows almost all particles smaller than 10 microns to pass through the filter material 24. Example III shows that, although the porosity of the air filter material is approximately 10 microns in size, when specific conditions of this invention are met; namely:

(1) when the effective output surface area of the filter material placed between the two electrodes is large enough to slow down the air velocity per unit area to a velocity significantly slower than 0.1 m/sec, and (2) when the voltage on the filter material for enhancing the effect of the Van der Waals force on the particles is 3 kV to 9 kV, then practically all particles ranging in size down to 0.01 micron are captured.

EXAMPLE IV

Filter materials with a natural electrostatic charge, such as 3M's Filtrete® or Toray's Tori-Micron® (Japan), have been introduced into the marketplace. Such filters are utilized for supplying clean air to opto-magnetic discs (a recently developed technology used in computer memory systems). These filter materials have also been recently introduced into the home air filtration market.

An experiment was conducted with such a naturally electrostatic material. The following conditions existed. Filter material 24 in the configuration shown in FIG. 1 was tested with and without a 7 kV DC voltage across the electrodes 18, 20. The surface air velocity at the material 24 was 0.01 m/sec. The contaminant used was cigarette smoke. The filter material 24 was rated to capture 65% of 0.3 micron particles at 0.016 m/sec air velocity. The experiment showed a better than 1,000% improvement in the filtration by having the 7 kV potential on the electrodes, as compared to the filtration obtained with no voltage. There was no notable change by reversing the polarity on the electrodes. At a higher air velocity, 1.10 m/sec., there was still a noticeable difference and improvement in the filtration by applying the 7 kV voltage, but the filtration efficiency was greatly reduced.

The same experiments were conducted with the distance between the electrodes at 1 cm and again at 2 cm, and the voltage at 7 kV. There was no noticeable difference in the filtration capability. Thus, it was concluded that the experiments confirmed that enhancement of particle capture by Van der Waals forces in an electric field is not directly related to electric field intensity (expressed by the voltage divided by the distance) but rather to the absolute potential.

EXAMPLE V

A 99.9% grade HEPA filter material was tested in a configuration equivalent to that shown in FIGS. 1 through 3. Particulates utilized for the air flow were commonly used dioctyl phthalate (DOP) sample contaminants. First, the efficiency of HEPA filter material for 0,065 to 0.3 micron particles was measured with and without the influence of a 6 kV electric field potential at 0.1 m/second surface air velocity. Using those measurement points, the efficiency of the HEPA filter material at 0.01 micron particle size was predicted by a computer extrapolation (there being no readily available measuring instruments on the market for measuring particles, on a real time basis, smaller than 0.065 μ). The addition of the 6 kV potential resulted in an efficiency increase in the HEPA by one order of magnitude (about 1,000%). Thus, it appears that fiberglass HEPA filter material can also be improved with the method of the present invention by utilizing a combination of Van der Waals forces and particle entrapment between electrodes at a potential of 3,00 V-9,000 V and designing the filter surface to be such that the air velocity per unit area of the material is sufficiently lower than 0.1 m/sec.

EXAMPLE VI

In this experiment, sixteen layers of cotton sheets (with a total thickness of 2 cm) were placed between the electrodes 18, 20 in the configuration shown in FIG. 1. The air velocity was about 0.03 meters/sec. The particles introduced were from cigarette smoke. The average cotton pore size was estimated to be about 100 microns. The experiment was performed twice. The first time a voltage of 7 kV was applied across the electrodes with the upstream electrode 18 being positive with respect to the electrode 20. The second time, no voltage was applied. In each instance, after consecutively burning two cigarettes, the cotton layers were separated and examined. Without a potential, a light stain was observed throughout the filter material 24 indicating that the smoke particles passed through the filter but deposited some particles in the filter material during their passage. With a voltage applied, the particles were completely absorbed in the first four layers, with the first layer having the greatest amount of brown stain. The coloring diminished rapidly in the second and third layers, and there was only faint discoloration in the fourth layer.

Another experiment was performed with three layers of a low grade (10% rated) filter material (a total thickness of 3 mm). DOP particle samples were used. The air velocity was 0.1 m/sec. The filter showed 40% capturing efficiency at 0.3 micron particle size without the electric field. With an electric field applied, the capturing efficiency went up to 70% at 6 kV, 93% at 8 kV, and 98.6% at 10 kV.

These experiments of Example VI show the following:

(1) Increasing the thickness of the filter material 24 substantially improves the effectiveness of filtration under a non-ionizing electrostatic field when the attraction of the Van der Waals force between the particles and the surfaces of the filtering material is electrically enhanced, and the air velocity is low enough (below 0.1 m/sec, but preferably 0.03 m/sec). In the present invention, the pore size is far larger than the particle size of interest, and one can design thicker filter material without creating larger differential pressure across the filter.

(2) The coarseness (porosity of the filter material 24 can be changed layer-by-layer (or continuously) to fill the filter material with particles throughout the material thickness by adjusting the porosities. For example, starting with a larger porosity material and gradually progressing to a smaller pore size material helps ensure that the particles are evenly captured and distributed throughout the entire thickness of the material, resulting in a large particle-holding capacity.

EXAMPLE VII

A set of experiments was conducted using a system basically represented in FIG. 1. The filter material 24 was placed between the two electrodes 18, 20. A potential of 10 kV was applied to the electrodes 18, 20. A 50% grade filter material was used. The measured capturing efficiency of 56% at 0 V increased to 80% at 10 kV, when the downstream electrode 20 was negative, and increased to 98% when the downstream electrode 20 was positive.

All conditions being the same a 10% grade filter material 24 was used. The results showed that the 20% measured capturing efficiency at 0 V was increased to 40%, when the downstream electrode 20 was negative, and increased to 90% when the downstream electrode 20 was positive.

Example VII showed that by the inventive technique, a low grade filter material (i.e., material of larger porosity such as cellulose) can achieve almost the same capturing efficiency as a higher grade expensive material (e.g. HEPA material). Larger porosity filter materials provide a lower air pressure drop across the surfaces. With a given pressure drop across the filter, a much thicker lower grade material can therefore be adopted, providing better filtration, as the probability of particle impact or contact with the filter fibers increases as the thickness of the filter material increases.

Example VII also showed that, as the electrode potential is raised beyond 9 kV, the polarity of the electrode potential becomes increasingly significant, possibly because of incipient ionization effects.

EXAMPLE VIII

With the air filter 54 of FIG. 4 being in the general configuration shown in FIG. 1, experiments were performed by having the filter material 24 make contact with the downstream electrode 20 rather than having the filter material 24 suspended in the space between the electrode 18 and 20. A dramatic improvement in filtration occurred.

The filter material used was a 1.2 mm thick HEPA material rated at 50–60 micron porosity and the effective size was 13.3 cm×20.3 cm. The voltage applied was 7 kV. The particles from the cigarette smoke were 0.01 to 1 micron in size. After passing through the filter assembly 54, the uncaptured smoke particles were collected on the membrane 58 and observed by discoloration.

At an air flow rate of about 0,026 m/sec through the filter material 24, two experiments were performed. In the first experiment, a space was left between the filter material 24 and electrode 20; the membrane 58 was completely dark brown. In the second experiment, the filter material 24 was allowed to contact electrode 20; the membrane 58 was almost completely its original white color, demonstrating a much greater efficiency of the filter 54.

The flow rate was increased tenfold and the experiments were repeated. There was still a significant difference between the two experimental results (with our without space between the filter material 24 and electrode 20), although the efficiency of filter 54 was substantially reduced. The polarity between the electrodes 128 and 20 was then reversed. With either polarity, the same results were observed. However, making the downstream electrode 20 positive increased the filter effectiveness slightly.

Similar results were obtained by causing the filter material 24 to contact the upstream electrode 18. However, in this case, an additional mechanical support was required for the filter material 24 (which is normally mechanically weak). Similar results were also obtained by placing the filter material in the front of the upstream electrode.

EXAMPLE IX

Another experiment was performed using a system essentially like that of FIG. 4, but using the double-layered filter structure shown in FIG. 6 for both filters 52 and 54. (The structure of FIG. 6 uses three electrodes 18, 20, 70 of alternating polarity and two layers 24, 72 of filter material, the material 72 being somewhat finer than the material 24.) The potential applied to filter 54 was 8 kV.

The surface velocity was about 0.1 m/sec. A handful of chopped garlic was heated and burned as the odor and particle source. The output from the filter 52 was intolerable to breathe; on the other hand, the output from the filter 54 was in a very comfortable odor zone, which almost resembled a good smell of cooking.

This experiment concluded that the filter structure of 54 with an electrical potential of 8 kV substantially eliminated the odor and fumes of garlic which have particle sizes ranging from 0.001–1 micron. Knowing the size distributions of fumes, smoke, and DO articulates, it was concluded that the experimental structure is also adequate for filtering out known bacteria (ranging 0.3–40 microns in size) and viruses (ranging 0.003–0.06 microns in size) from gaseous fluids.

Importantly, when the air flow was stopped, if the electric field was not released, no odor was emitted by the filter, That is, the odorous substance, or particles, was captured and held. When the electric field was released, the accumulated substance began to propagate the odor into the environment through the outlet. Note that normally an air filter which deals odorous airborne substance is to be used, it is followed by an addition filter (commonly activated charcoal is used) to prevent spreading of odor from the collected odorous substance when the air flow is stopped. In the present invention this is not necessary.

The same experiment was also performed with onion, soy sauce, and food burning in oil for elimination of smoke and odor and utilizing activated charcoal as hereinbefore discussed. Similar excellent results were obtained in minimizing smoke and odor.

EXAMPLE X

Figure 5A:
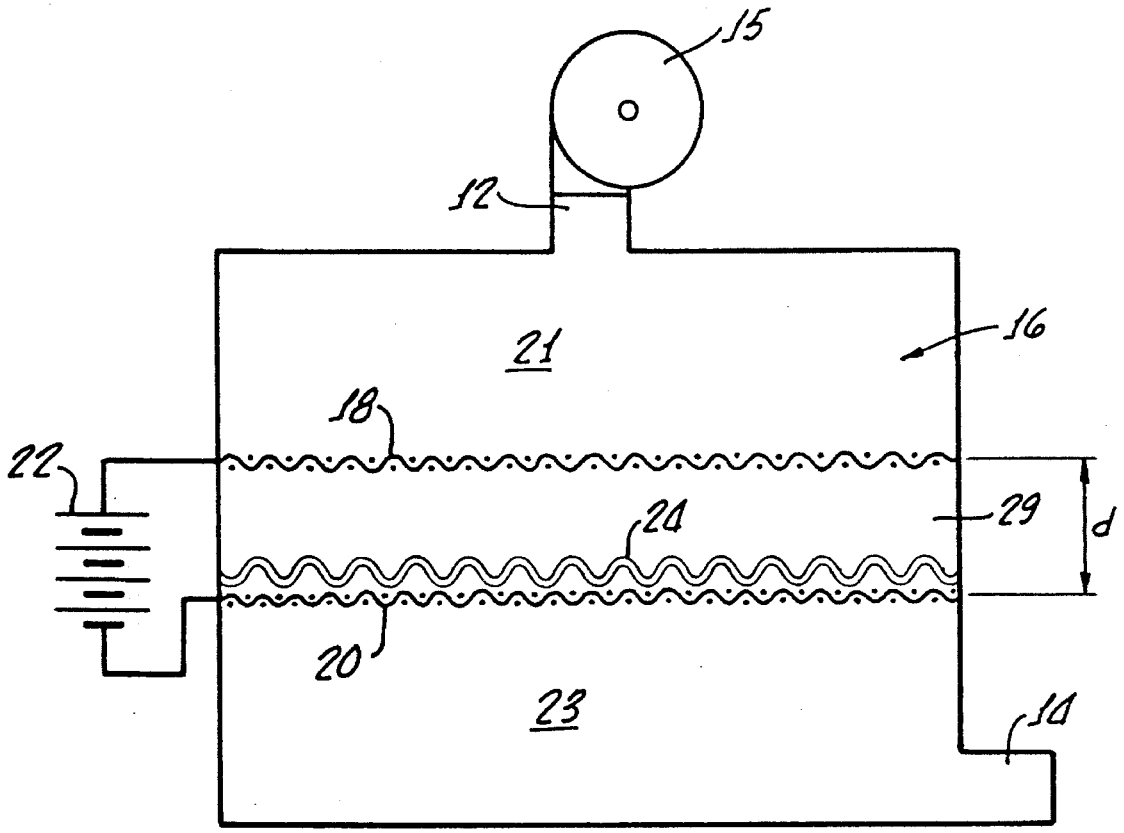
Figure 5B:
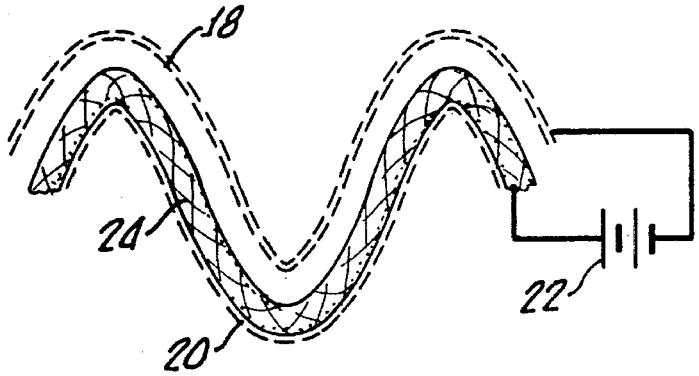

In lieu of a conductive filtering material (or filtering material treated or coated with conductive substance) in FIG. 5*a*, a special filter material with sub-micron diameter metallic wires mixed in was used. The wires are chopped and mixed with paper filter material. This filter material with chopped microscopic metal pieces was placed as shown in FIG. 5*a*. The surface air velocity was 0.03 m/sec. Although the metallic pieces in the filter material were not directly in contact with the electrode 20, the induced electric field around each metallic piece significantly enhanced the interaction between the filter material and the Van der Waals force on the particles, resulting in an excellent filtration in comparison with the same filter material without electric potential. This structure of the filter material also minimized needed potential (even below 2,000 V) for creating the required electric field for the subject filtration technique which relies on the Van der Waals force.

The principles of the present invention can, of course, be carried out in a variety of configurations.

Turning now to FIG. 7, there is shown an alternative assembly 100 in accordance with the present invention. The assembly 100 includes electrodes 101, 102, 103 with one or more electrodes (e.g., 102 or 103) which are electrically floating, that is, without direct electrical connection to any voltage source. Electrodes 101, 102, 103 are essentially parallel to each other. However, the configuration may be in the form of concentric cylinders (as shown in FIG. 9) or similar structure whereby the relationships of the electrodes are maintained as "parallel".

All of the electrodes 101, 102, 103 have a mesh-type form which allows air/fluid to pass through. Between a pair of electrodes 101 and 102, a filter material 104 is disposed, which has a much larger surface area than the cross-sectional area of the intake 106 or 107. The preferred form of the filter material 104 is pleated. An additional coarse filter material 109 may be disposed adjacent the floating electrodes 103 which also may be in a convoluted form. The high voltage source 118 is connected with electrodes 101 and 102 through the terminals 114 and 115 with the electrode 103 floating electrically without any connection.

FIG. 7 shows the filter assembly encased in a housing 105. First, air/fluid enters into the filter housing 105 through the intake 106. Passing through the chamber 107, air/fluid enters into the pre-filter material 109. The floating electrode 103 receives induced electrical potential from the electrode 102. In turn, electrode 103 electrically influences the filter material 109 in such a way that interaction between the particulates in air/fluid and the filter material (109) is enhanced, causing some particulates to become entrapped within the filter material 109. The porosity of the filter material 109 is normally chosen to be larger than the porosity of the filter material 104 so that the total filter effectively captures a wide range of particles, including lint and larger dust particles, as well as submicron size germs and cigarette smoke particles.

The air/fluid proceeds into the chamber 119 through the chamber 108 and through the electrode 102. Filter material which has a larger surface area than the cross-sectional area of the chamber 108 is placed between the 102 and 103 electrodes. As is shown in Example I, the motion of the particles tends to be perpendicular to the direction of the flow of the air/fluid in both filter materials 109 and 104. Thus, the electrostatic influence on the particles in air/fluid increases the probability that the particles will make contact with the surfaces of the fiber-like materials of the filter. This perpendicular motion of the particles observed under the influence of an electrostatic field causes significant improvements in filtration. Unexpectedly, experimentation clearly shows distinctive filtration improvement when the electrode 103 is electrically floating and influenced by the electrical potential by electrode 102 than when it is connected to another fixed voltage power supply 1100, as shown in FIG. 7.

In summary, particulates carried in air/fluid are filter out in the following way:

(1) First, larger particles are trapped within the filter material 109 under the influence of induced potential on the electrode 103 which creates a perpendicular motion of the particles.

(2) Next, the air velocity per unit area in the filter material 104 is reduced because the area of the filter material is larger than the cross-sectional area of the air path.

(3) Further, the effective particle velocity traveling across the filter is reduced, and the resident time of the particles in the filter materials is increased because of the influence of the electrostatic fields among the electrodes 101, 102 and 103.

Because of the transverse motion of the particles carried in air/fluid due to the electrostatic fields, the porosity of the filter materials can be very large in comparison with the sizes of particles to be filtered out.

Another configuration of floating electrodes can be utilized whereby the electrical potential provided by the voltage source 118 is applied between the electrodes 101 and 103, as shown in FIG. 8*b*, and the electrode 102 is floating electrically. In this case electrode 102 has a two-fold function. One is to unify and evenly spread out the electric field (equipotential line) over the tips of the filter material 104 pointing towards the electrode 102 (as shown in FIG. 11) which creates more efficient filtration.

The other function is to set up a uniform electric field across the filter material 104 which is situated between the electrodes 101 and 102. The floating electrode 102 relies on the induced potential of electrode 103 for its effectiveness. This electrode 103 is connected (see FIG. 8*b*) to the high voltage supply 118. It should be noted that if the electrode 102 is tied directly to another fixed voltage source (rather than electrically floating), the effect of filtration is greatly decreased.

Needless to say, a combination of a four-electrode filter (as shown in FIG. 8*c*) can be constructed whereby there are two floating electrodes; namely:

(1) between the pair of electrodes with the fixed potential, and (2) on the intake side as a combination of the two above-described configurations.

FIG. 9 shows another arrangement of the filter utilizing floating electrode(s). In this illustration, a cylindrical filter 129 is constructed of three layers of electrodes 123, 124 and 125. The filter is placed in housing 130. The pre-filter material 122 is placed on the electrode 123. In manufacturing, this structure offers less critical specifications of filter element designs, and the end product provides easier maintenance of inner electric field relationships than the previously shown planar filters.

Air/fluid, carrying particulates, is induced into the chamber 121 through the intake 120. That air/fluid goes through the pre-filter material 122, mesh-like electrodes 123,124 and the filter material 131 and the electrode 125 into the final chamber 126 and then to the exhaust 128. A fan 127 is to create the air flow, and the fan can be placed in the intake side as well.

In the first case, the electrode 123 is electrically floating (not connected to any power source), and a pre-filter 122 is placed on electrode 123. Potential is applied between electrodes 124, 125, which sandwiches the filter material 131. The filter material 131 has a much larger surface area than that of the electrodes 123, 124, 125. The electrodes 123, 124, 125 are essentially spaced evenly from and parallel to one another.

The air/fluid, carrying particles, enters into the chamber 121 through the intake 120. The floating electrode 123 is charged under the influence of induced electric potential from the electrode 124 thereby electrifying the filter material 122, as well as creating the transverse motion of particles within the air/fluid, causing the particulates to be efficiently trapped within the filter material 122.

Air/fluid then proceeds through the electrodes 123, 124 and reaches into the space created between electrodes 124, 125. Effective air velocity per unit area on the filter material 131 is reduced on the larger surface area. Additionally, the effective velocity of the particulates in air/fluid is further slowed due to the churning motion created by electrostatic field between the electrodes 124, 125, causing the particulates to interact with and adhere to the filter material 131. The most convenient form for filter material 131 and filter material 122 (if enough space is allowed) is pleats. It should be appreciated that the filter materials 122,131 may be replaceable in order to provide maintenance economy.

FIG. 10 shows the parallel and evenly spaced relationship of filter materials 131, 122 and electrodes 123, 124, 125. Of course, the flow of air/fluid can be reversed, and the electrodes and filter materials constructing the filter can be rearranged in such a way that the air/fluid enters from the outer electrodes and exits from the inner chamber.

Although FIG. 7 shows a particular arrangement of electrodes in relationship to the electrical potential (the plus side of the power source is connected to the screen 102), this arrangement of electrical potential can be reversed.

The pre-filter 109 may consist of materials such as carbon-impregnated foam for more effectively reducing odor than the same foam, by itself, without the influence of the electrical field. Further, the filter materials 109,104 may be selected to minimize the passage of certain microscopic organisms (e.g., bacteria) or chemical substances in air/fluid.

The most preferred embodiment for highly efficient filtration is the structure first described whereby the electrode 103 in FIG. 7 is electrically floating, and the potential is applied across electrodes 101, 102 where electrode 102 is positive and electrode 101 is grounded. The distance between the electrodes 101, 102 can be 5 mm to 50 mm. However, the best distance between them is about 12 to 15 mm, with the potential applied to be about 10,000 V, The spacing between electrodes 102, 103 can also be between 5 mm to 50 mm; again, however, the best distance between them is about 12 to 15 mm. In this case, observed induced voltage on electrode 103 due to electrode 102 is about 6,000 V.

When the fixed potential is applied between electrodes 101, 103, and electrode 102 is floating, the preferred distance between electrodes 101, 103 is about 25 to 30 mm with floating electrode 102 in the middle. Potential across electrodes 101, 103 is about 20,000 to 25,000 V and some portion of the airborne particles in the air will be ionized. In this case, the observable induced electric potential on electrode 102 is about 10,000 V. The first configuration is most preferable as it provides the most efficient filtration than anything known or experimented with heretofore; and the terminal voltage (about 10,000 V across electrodes 101, 102) is low enough to avoid ionization of the particles which may cause the generation of ozone.

A further advantage of the aforementioned structure, in accordance with the present invention, is that electrode 102, carrying a high voltage (10,000 V), is situated between the grounded electrode 101 and floating electrode 103. Thus, this structure potentially isolates the high voltage electrodes for the potential hazard of electric shock.

Although there has been hereinabove described a filter for particulate materials in gaseous fluids in accordance with the present invention, for the purpose of illustrating the manner in which the invention may be used to advantage, it should be appreciated that the invention is not limited thereto. Accordingly, any and all modifications, variations, or equivalent arrangements which may occur to those skilled in the art, should be considered to be within the scope of the present invention as defined in the appended claims.

What is claimed is:

1. Filter apparatus for trapping particles suspended in a gaseous fluid stream, said filter apparatus comprising:

a) filter chamber means for defining an air flow path between an inlet and an outlet;

b) a porous filter positioned in said flow path, said porous filter comprising a dielectric fibrous material having a natural electrostatic charge and a pore size substantially larger than the average diameter of the particles to be trapped, said filter having a collection surface thereon substantially larger than a cross section of the flow path;

c) impelling means for causing said gaseous fluid stream and particles suspended therein to flow along said flow path and through said porous filter:

d) spaced apart electrode means, positioned in an operative relationship with said porous filter material, for enhancing trapping of said particles by said porous filter, said electrode means being parallel, positioned between said inlet and outlet and having means defining openings therein for enabling air flow therethrough, said electrode means comprising three electrodes positioned in a spaced apart relationship with the porous filter material between two of the three electrodes, said air flowing sequentially through a first electrode, a second electrode, the porous filter, and then through a third of the three electrodes; and e) means for applying a selected DC voltage across any two of the electrodes, the DC voltage being selected to prevent ionization of particles passing through the filter, the operation of the filter for trapping particles being dependent more on the selected DC voltage than on the electrode spacing.

2. The filter apparatus according to claim 1, wherein the means for applying the voltage is configured for applying the voltage across the second and third electrodes.

3. The filter apparatus according to claim 1, wherein the means for applying the voltage is configured for applying a non-ionizing voltage across two of the electrodes.

4. The filter apparatus according to claim 1, wherein the means for applying the voltage is configured for applying an ionizing voltage across two of the electrodes.

5. The filter apparatus according to claim 1, further comprising a second porous filter disposed adjacent the first electrode.

6. Filter apparatus for trapping particles suspended in a gaseous fluid stream, said filter apparatus comprising:

a) filter-chamber means for defining an air flow path between an inlet and an outlet;

b) a porous filter positioned in said flow path, said porous filter comprising a dielectric fibrous material having a natural electrostatic charge and a pore size substantially larger than the average diameter of the particles to be trapped, said filter having a collection surface thereon substantially larger than a cross section of the flow path;

c) impelling means for causing said gaseous fluid stream and particles suspended therein to flow along said flow path and through said porous filter;

d) spaced apart non-ionizing electrode means, positioned in an operative relationship with said porous filter material, for increasing a residence time of the particles in and about said porous filter and cause churning of the particles within the filter as the gaseous fluid stream passes through the porous filter for enhancing trapping of said particles by said porous filter, said electrode means being parallel, positioned between said inlet and outlet and having means defining openings therein for enabling air flow therethrough without significant resistance, said electrode-means comprising three electrodes positioned in a spaced apart relationship with the porous filter material therebetween, said air flowing sequentially through a first electrode, a second electrode, the porous filter, and then through the third electrode; and e) means for applying a selected DC voltage across any two of the electrodes, the DC voltage being selected to prevent ionization of particles passing through the filter, the operation of the filter for trapping particles being dependent more on the selected DC voltage than on the electrode spacing.

* * * * *